US005187956A

United States Patent [19]

Phillips et al.

[11] Patent Number: 5,187,956

[45] Date of Patent: Feb. 23, 1993

[54] PREVENTING CLOGGING IN PRESSURE DIFFUSERS

[75] Inventors: Joseph R. Phillips; Peter E. T. Warloff; John Hefele; Victor L. Bilodeau; Ronald G. Bain; Mark Barrett, all of Glens Falls, N.Y.

[73] Assignee: Kamyr, Inc., Glens Falls, N.Y.

[21] Appl. No.: 718,294

[22] Filed: Jun. 20, 1991

[51] Int. Cl.[5] ..... D21D 5/04

[52] U.S. Cl. ..... 68/181 R; 68/184; 162/60; 162/251; 210/333.01

[58] Field of Search ..... 68/181 R, 184; 8/156; 134/25.5; 162/60, 251; 210/333.01, 456, 342, 334

[56] References Cited

U.S. PATENT DOCUMENTS

| | | | |
|---|---|---|---|
| 1,915,812 | 6/1933 | Wollenberg | 8/156 |
| 2,772,138 | 11/1956 | Evans | 8/156 |
| 3,311,530 | 3/1967 | Justus et al. | 162/60 X |
| 4,093,511 | 6/1978 | Richter | 68/181 R X |
| 4,157,245 | 6/1979 | Mitchell et al. | 134/25.5 X |
| 4,158,597 | 6/1979 | Petterson | 68/181 R X |
| 4,161,421 | 7/1979 | Sherman | 68/181 R X |
| 4,162,215 | 7/1979 | Klotz | 162/60 X |
| 4,908,896 | 3/1990 | Jacobsen et al. | 210/333.01 |
| 4,944,167 | 7/1990 | Jacobsen et al. | 68/181 |
| 5,044,179 | 9/1991 | Jacobsen et al. | 68/181 R |

*Primary Examiner*—Frankie L. Stinson
*Attorney, Agent, or Firm*—Nixon & Vanderhye

[57] ABSTRACT

In a pressure diffuser, clogging of the tapered inlet passageway at the bottom of the vessel is minimized by providing a number of lubricating fluid introducing nipples disposed circumferentially around the annular passageway. The nipples introduce lubricating fluid so that it flows upwardly along the inner wall of the vessel. The vessel inner wall and the bottom support for the screen at the passageway are polished and free of projections, so that friction is minimized. The nipples are provided in sets that are staggered so that a nozzle is placed about every 15° around the circumference of the vessel, and a common annular header—mounted on the support legs of the vessel—provides the lubricating fluid. Should screen movement slow as a result of paper pulp properties near the screen bottom support, the flow rate of lubricating liquid can be increased so as to significantly dilute the pulp at the passageway until slow movement of the screen is overcome.

19 Claims, 3 Drawing Sheets

PREVENTING CLOGGING IN PRESSURE DIFFUSERS

BACKGROUND AND SUMMARY OF THE INVENTION

In the treatment of comminuted cellulosic fibrous material suspensions—paper pulp—, particularly in the thickening, washing, and bleaching thereof, an effective commercial vessel is a pressure diffuser. A very successful pressure diffuser is that sold by Kamyr, Inc. of Glens Falls, N.Y. under the trademark "MC®." The invention can also be utilized with a double stage pressure diffuser such as in co-pending U.S. application, Ser. No. 07/718,294, filed Apr. 16, 1991; variable stage diffusers; a type of pressure diffuser such as shown in U.S. Pat. No. 4,944,167; or any other type of pressure diffuser.

A pressure diffuser is typically used for washing medium consistency pulp, e.g., having a consistency of about 6–15%. Pulp enters the bottom of an upright vessel and moves upwardly forming an annular mat between an interior screen and the vessel shell. At the top, the pulp is agitated by a scraper and is expelled from the vessel through a pulp outlet. As the annular pulp mat moves upwardly in the vessel, water from the wash water headers passes through the pulp mat to the screen, washing the pulp. A hydraulic system moves the screen upwardly at approximately the pulp upward velocity, and then downwardly quickly to clean the screen by wiping and backwashing.

While commercial pressure diffusers are very successful and worthwhile machines, there are some circumstances under which they can be clogged. Clogging of the pressure diffuser is a very serious situation, which requires that the vessel—and perhaps a number of components cooperating with the vessel—be shut down until the clog is cleared. Clogging typically occurs near the pulp inlet to the bottom of the vessel. Near the pulp inlet, a bottom support is provided for the screen, mounted centrally of the vessel, and defining with the interior wall of the vessel at that area an annular passageway. This annular passageway tapers in cross-section (getting progressively smaller) as the pulp moves from the pulp inlet up to an interior volume between the screen and the interior wall of the vessel.

In the past where clogging problems have been anticipated—such as when softwood pulp with long fibers is typically to be washed using the diffuser—the bottom support for the screen and the inner vessel wall surface defining the passageway have been polished to reduce friction. However, even this polishing does not minimize the chances that the diffuser will clog.

According to the present invention, the friction at a free annular passageway near the pulp inlet in a pressure diffuser is minimized by introducing lubricating fluid (typically water) into the annular passageway. The introduction of the lubricating fluid is preferably accomplished utilizing first and second pluralities of nipples disposed circumferentially around the annular passageway in the wall of the vessel defining the passageway. Each nipple is connected—preferably through a valve—to a source of liquid under pressure slightly higher than the pressure in the passageway, and is introduced at a flow rate such that the liquid flows upwardly along the wall of the vessel from its point of introduction between the pulp and the wall, thereby providing minimum friction of the pulp with the wall, and thus minimizing the possibility of clogging.

Typically the wall at the passageway comprises a curved portion, and a straight (vertical) portion above the curved portion. The first plurality of the nipples is disposed in the wall straight portion, and the second plurality of nipples is disposed in the wall curved portion. Preferably the nipples of the two sets are circumferentially staggered with respect to each other, and are each twelve in number so that a nipple is disposed approximately every 15° around the circumference of the annular passageway.

Located just above, or at the level of, the screen bottom support, a baffle is provided associated with the wash system for facilitating the proper introduction of wash liquid. To further minimize clogging, according to the invention, that baffle is of stainless steel or a metal with a low friction interior surface coating. Also—as known per se in the prior art—the exterior surface of the screen bottom support and the vessel inner wall where it defines the passageway are both polished so that they are free of any significant surface manifestations and thereby provide low friction to the flow of pulp.

A common annular header which supplies lubricating liquid to the nipples preferably is mounted on generally horizontally extending plates connected to the support legs for the vessel, and held to the plates by U-bolts.

While the lubricating fluid introduced by the nipples is typically at a flow rate such that it only performs a lubricating function, and does not significantly dilute the pulp at the passageway, the nipples can be operated to perform a diluting function too. If an operator of the pressure diffuser senses slow down stroke of the screen (the screen is designed to move downwardly very quickly, and if it does not, screen cleaning is not as effective), the operator may believe that the slowed down stroke is a result of the pulp properties near the screen bottom support. In order to remedy this condition, the operator need only increase the flow rate of lubricating liquid (typically water) applied by the nipples so as to significantly dilute the suspension at the passageway until the slow downward stroke of the screen is overcome, at which time the original, only lubricating, flow rate operation of the nipples is restarted.

It is the primary object of the present invention to provide a pressure diffuser, and method of treating paper pulp in such a diffuser, that minimizes the friction between the pulp and the vessel adjacent the pulp inlet, to in turn minimize the tendency of the annular pulp passageway adjacent the inlet to clog. This and other objects of the invention will become clear from an inspection of the detailed description of the invention and from the appended claims.

DETAILED DESCRIPTION OF THE DRAWINGS

Figure 1:
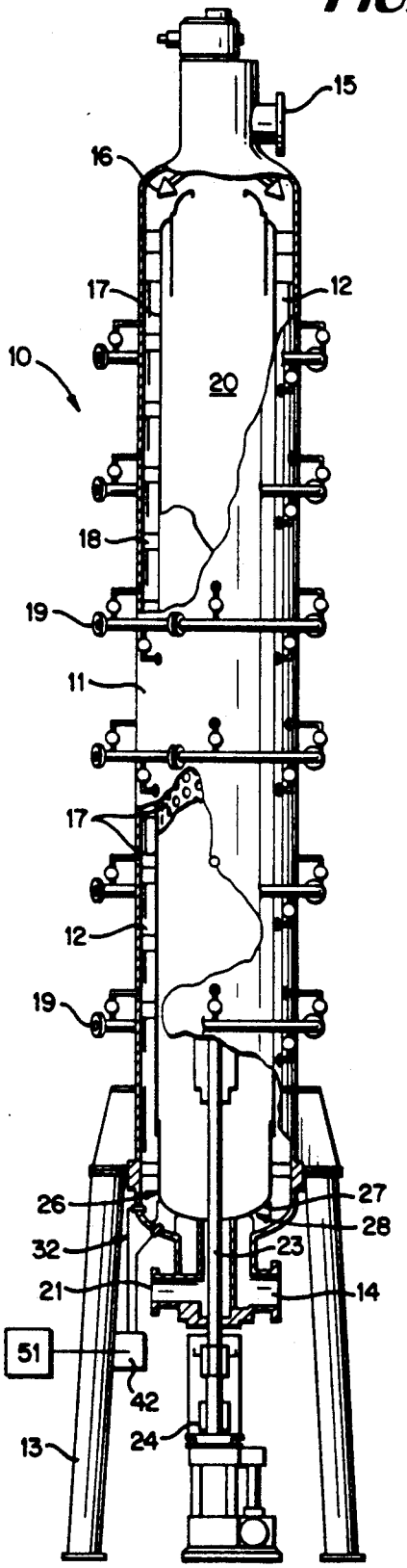
FIG. 1 is a side view, partly in cross-section and partly in elevation, of an exemplary pressure diffuser according to the present invention.

The pulp treating apparatus—pressure diffuser—according to the present invention is shown generally by reference numeral 10 in FIG. 1. Conventional components of the pressure diffuser comprise generally upright, liquid tight, pressurized vessel 11 defining a first interior volume 12 for containing pulp to be treated under pressure, and mounted by support legs 13, with a pulp inlet 14 at the bottom of the vessel 11 and a pulp outlet 15 at the top of the vessel. To facilitate discharge of the pulp from inlet 15, the conventional scraper mechanism 16 and the like is preferably provided. A screen 17, defining a surface of revolution, upstands within the vessel 11 and defines, with the inner wall 18 of the vessel, a first interior volume 12. Comminuted cellulosic fibrous material suspension (paper pulp) passes upwardly in an annular mat in the volume 12 during treatment.

Although under some circumstances the apparatus 10 can be used for thickening, typically it is used for washing or other liquid treatment, wash liquid or the like being introduced through introduction apparatus 19 located at various positions along the vessel 11. A second interior volume 20 is defined within the screen 17, wash liquid passing through the pulp into the volume 20, and ultimately then being discharged through outlet 21.

During operation of the device 10, the screen 17 periodically is reciprocated. A central rod 23 is connected to a hydraulic system 24 or the like at one end, and to the interior of the screen 17 at the other. The system 14 reciprocates the screen 17 up slowly—at approximately pulp upward velocity—until the end of travel of the stroke has been reached, and then pulls the screen 17 quickly downwardly. Due to the taper of the screen 17 (being spaced further from the interior wall 18 of the vessel at the top thereof and then near the bottom thereof); cleaning of screen 17 is accomplished by the backflushing liquid from the volume 20, and by a scraping action.

Figure 2:
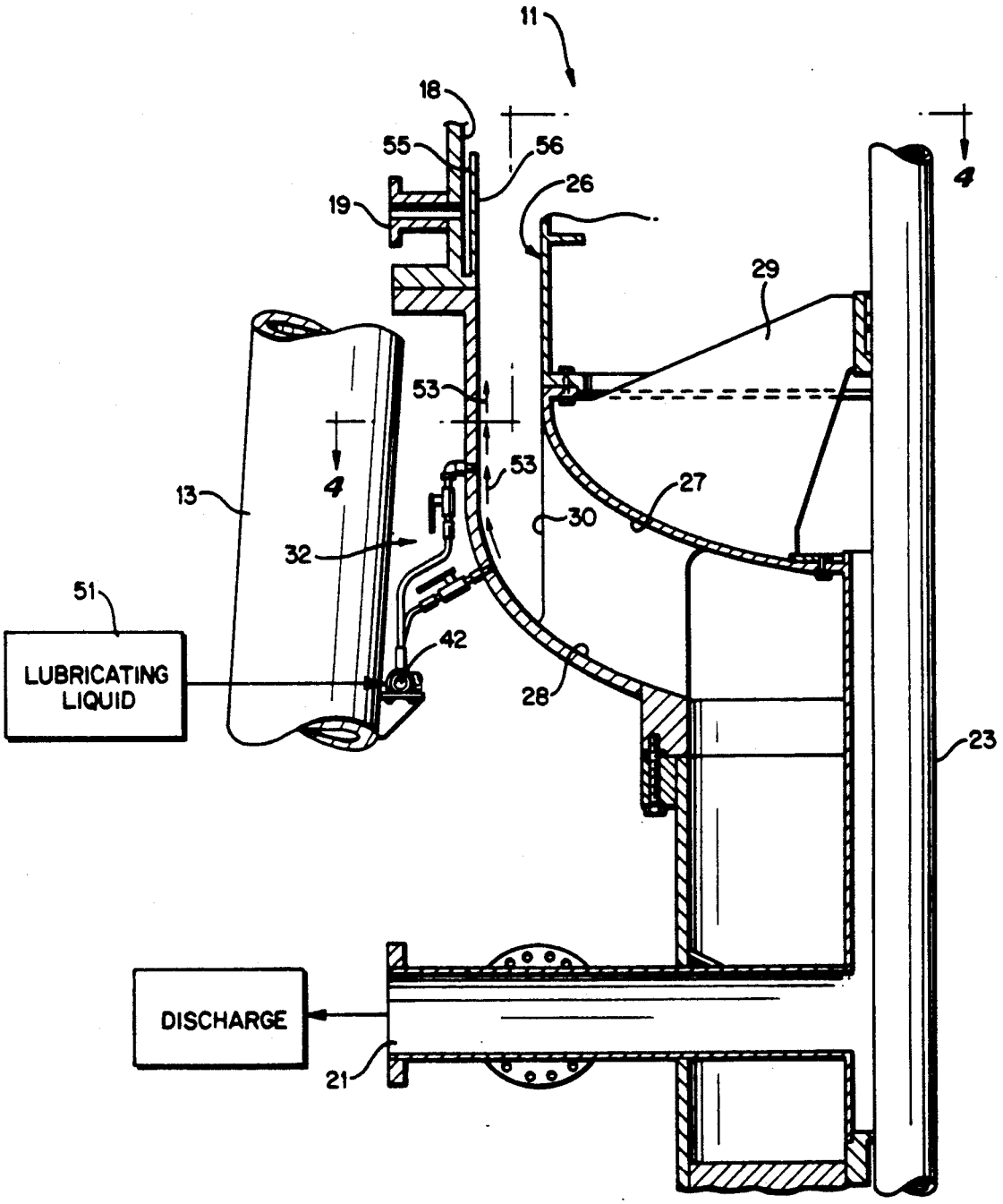
FIG. 2 is a partial cross-sectional view showing an annular passageway for the pulp adjacent the pulp inlet of the diffuser of FIG. 1, and illustrating the lubricating means according to the invention.

The screen 17 is mounted at the bottom thereof by a stationary, closed bottom support 26, having an exterior surface 27 (shown most clearly in FIG. 2). Preferably a plurality of arms 29 are provided connected between the bottom support 26 and a bushing for the rod 23 to guide reciprocation of the rod 23. Spaced from the surface 27 is an inner wall section 28 of the vessel which defines an annular passageway 30 with the screen support exterior surface 27. The annular passageway 30 decreases in cross-sectional area moving from the pulp inlet 14 toward the first volume 12. Because of this decreasing cross-sectional area, the passageway 30 has a tendency to clog especially when softwood pulp with long fibers is being treated by the diffuser 10.

In order to minimize the friction between the pulp and the surfaces 27, 28 defining the passageway 30, it is desirable to eliminate the surface irregularities in the surfaces 27, 28, by grinding all the surface irregularities (including weld seams) off, and finishing by sanding to a "D" finish. That is, the surfaces 27, 28 are polished. However, even with polished surfaces 27, 28, the diffuser 10 will still clog under certain conditions.

What has heretofore been described is conventional. What is provided according to the present invention is a means—shown generally by reference numeral 32—for introducing lubricating fluid into the passageway 30 so as to further reduce (minimize) the friction between the pulp and the surfaces 27, 28 and thereby minimize the tendency of the passageway 30 to clog.

The lubricating fluid introduction means 32 preferably takes the form of a plurality of nipples, preferably a first plurality of nipples 34 (see FIGS. 3 and 4) disposed in a vertical straight section of the wall 28, and a second plurality of nipples 36 disposed in a curved section of the wall 28. As seen in FIG. 4, the nipples 34, 36 are circumferentially staggered and extend completely around the interior wall 28. The nipples 34, 36 will be spaced so as to effectively supply lubricating fluid to the entire surface 28 at and above the nipples 36. In the preferred embodiment illustrated in FIG. 4, twelve nipples 34 and twelve nipples 36 are provided. Nipples 34, 36 are spaced about 30° from like nipples, and about 15° from dissimilar nipples (i.e., each nipple 34 is spaced 15° from the closest nipples 36 on either side thereof, and 30° from the closest nipples 34 on either side thereof).

Figure 3:
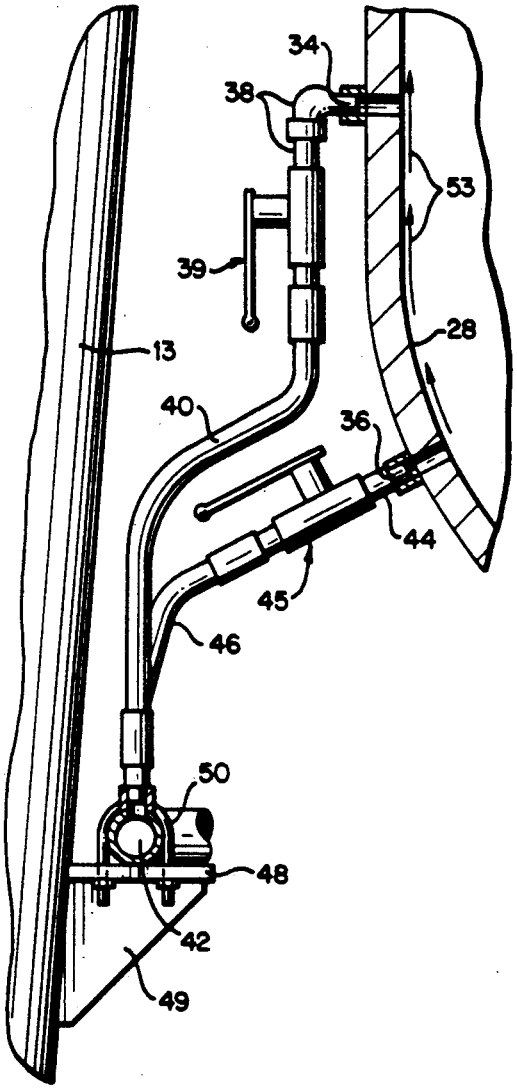
FIG. 3 is a more detailed view of the lubricating means of FIG. 2.
Figure 4:
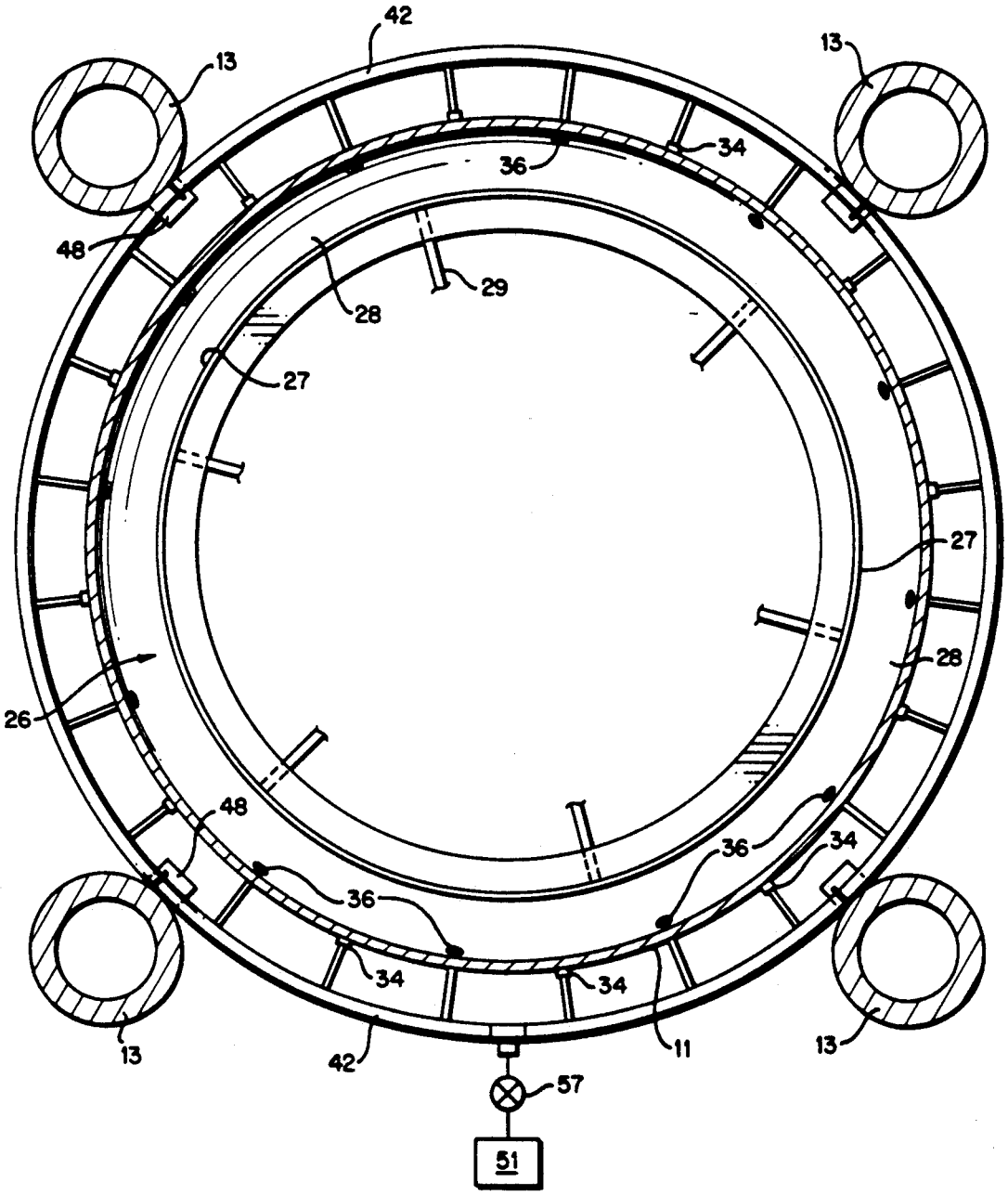
FIG. 4 is a horizontal cross-sectional view of the diffuser of FIG. 1, taken along lines 4—4 of FIG. 2, with conventional interior components of the screen cut away for clarity of illustration.

As illustrated most clearly in FIG. 3, preferably each nipple 34 is connected by an elbow and conduit 38 to a manual valve 39, and then by a piece of tubing 40 to an annular header 42. Each nipple 36 is connected by conduit 44 to a manual valve 45, and then by tubing 46 to the annular header 42. The annular nature of the header 42 is clearly seen in FIG. 4. In order to effectively and simply mount the header 42, preferably a generally horizontally extending plate 48, supported by a gusset 49, is attached by welding or mechanical fasteners to each of the four support legs 13 and the annular header 42 is supported by the top surface of the plate 48. In order to hold the annular header 48 in place, one or more U-bolts 50 are provided associated with each plate 48. Lubricating fluid—preferably liquid, e.g., wash water or the like—is provided from source 51 to the header 42, by any conventional means.

FIGS. 2 and 3 schematically illustrate the flow of lubricating liquid—indicated by arrows 53—when introduced through the nipples 34, 36. The lubricating liquid introduced by the nipples 34, 36 is only at a pressure slightly higher than the pressure within the passageway 30 (the entire vessel 11 is at a pressure substantially greater than 1 atmosphere), and at a flow rate so that substantial dilution of the pulp in the passageway 30 does not occur but rather the lubricating liquid has a tendency—as indicated by arrows 53—to flow upwardly immediately adjacent the surface 28 to provide minimal friction. In order to further minimize friction, it is also desirable to construct the first wash liquid baffle plate 55—see FIG. 2—in a particular manner.

The baffle plate 55 is known per se, and is at or slightly above the screen bottom support 26, connected to a wash apparatus 19. According to the invention, the first baffle plate 55 is constructed of a low friction material—such as stainless steel—or at least has on the interior metal surface 56 thereof a low friction coating. Such a coating would have the desirable properties of polytetrafluoroethylene, but would not contaminate the pulp.

While the lubricating means 32 are primarily for a lubricating function—as described above—in aberrant operating conditions of the diffuser 10 they can perform another function. If as a result of the properties of the pulp at the bottom of the screen 17, the down stroke of the screen is slowed, efficiency of the diffuser 10 will degrade. When an operator senses the slow down stroke of the screen 17, the operator can—either manually by operating the valves 39, 45 or automatically by operating a common valve 57 (see FIG. 4) from the lubricating liquid source to the header 42—significantly increase the flow rate of liquid supplied by the nipples 34, 36, so that the liquid penetrates the pulp mat in the passageway 30 and significantly dilutes the pulp at that volume. The dilution of the pulp at that volume will remedy the slow screen down stroke problem, and once the problem is remedied, the control of the nipples 34, 36 reverts to the low-flow, lubricating mode.

Thus, a method according to the present invention for treating comminuted cellulosic fibrous material comprises the following steps: (a) introducing suspension (pulp) under pressure into the pulp inlet 14 so that it flows vertically within the first interior volume 12, the pulp being maintained at a pressure significantly greater than 1 atmosphere throughout its passage in the vessel 11; (b) extracting liquid through the screen 17 into the second interior volume 20, the liquid being withdrawn from the pulp in the first volume 12; (c) introducing a first treatment liquid through the circumferential side walls (via apparatus 19) of the vessel 11; and (d) minimizing the friction between the suspension and the inner wall 28 at the passageway 30 so as to minimize the chance that the passageway 30 will clog, by introducing a lubricating fluid (from source 51) between the inner wall 28 and the pulp at the passageway 30 with a pressure greater than the pressure in the vessel at the passageway 30, and at a flow rate so that the fluid flows vertically with the pulp along the inner wall 28. The method also comprises the further steps of reciprocating the screen 17 up and down with the hydraulic device 24 and rod 23, and—in response to slow movement of the screen 17 as a result of pulp properties near the screen bottom support 26—increasing the flow rate of lubricating liquid applied in step (d) so as to significantly dilute the pulp at the passageway 30 until slow movement of the screen 17 in the down stroke is remedied.

It will thus be seen that according to the present invention a method and apparatus have been provided which minimize the possibilities of the pressure diffuser clogging.

While the invention has been described in what is presently conceived to be the most practical and preferred embodiment, it will be apparent to those of ordinary skill in the art that many modifications may be made thereof within the scope of the invention, which scope is to be accorded the broadest interpretation of the appended claims so as to encompass all equivalent apparatus and methods.

What is claimed is:

1. A pulp treating apparatus comprising:

a generally upright, liquid-tight, pressurized vessel defining a first interior volume for containing pulp to be treated under pressure;

a pulp inlet to the bottom of the vessel;

a pulp outlet from the top of the vessel, the pulp flowing generally vertically between said pulp inlet and said pulp outlet;

a screen defining a surface of revolution upstanding within the vessel and defining, in part, said first interior volume containing pulp, said screen located centrally in said vessel and having a top and bottom;

extraction means for withdrawing liquid from the pulp, through said screen, and including means defining a second interior volume within the vessel for receiving the extracted liquid;

a stationary, closed bottom, support for the bottom of said screen, having an exterior surface;

a first inner wall section of said vessel just above said pulp inlet and defining with the exterior surface of said bottom support an annular passageway that decreases in cross-sectional area in the direction from said pulp inlet toward said pulp outlet; and means for introducing lubricating fluid into said annular passageway between said first inner wall section and the pulp flowing in the passageway so that the friction between the pulp and said first inner wall section is minimized, and so therefore is the tendency of said passageway to clog.

2. Apparatus as recited in claim 1 wherein said lubricating fluid introducing means comprises a plurality of nipples disposed circumferentially around said annular passageway, in said first inner wall section, each connected up to a source of fluid under a pressure higher than the pressure in said passageway.

3. Apparatus as recited in claim 2 wherein said first inner wall section comprises a curved portion, and a straight portion above said curved portion; and wherein said plurality of nipples comprises a first and second plurality, said first plurality of nipples disposed in said first inner wall section straight portion, and said second plurality of nipples disposed in said first inner wall section curved portion.

4. Apparatus as recited in claim 3 wherein said first plurality of nipples are circumferentially staggered with respect to said second plurality.

5. Apparatus as in claim 4 wherein said first and second pluralities of nipples combined are disposed approximately every 15° around the circumference of said first inner wall section.

6. Apparatus as recited in claim 5 further comprising a second inner wall section of said vessel, above said first inner wall section, and generally parallel to said screen; and wherein said second section has a low friction inner surface so as to minimize the tendency of said first interior volume to clog.

7. Apparatus as recited in claim 6 wherein said second section is made of a material selected from the group consisting essentially of stainless steel and metal with a low friction interior surface coating.

8. Apparatus as recited in claim 2 further comprising means for reciprocating said screen up and down within said vessel.

9. Apparatus as recited in claim 8 wherein said first inner wall section and said stationary, closed bottom support exterior surface are of polished metal, free of imperfections and projections, including free of weld seams.

10. Apparatus as recited in claim 9 wherein said first inner wall section comprises a curved portion, and a straight portion above said curved portion; and wherein said plurality of nipples comprises first and second pluralities, said first plurality of nipples disposed in said first inner wall section straight portion, and said second plurality of nipples disposed in said first inner wall section curved portion.

11. Apparatus as recited in claim 10 wherein said first plurality of nipples are circumferentially staggered with respect to said second plurality.

12. Apparatus as recited in claim 9 further comprising a second inner wall section of said vessel, above said first inner wall section, and generally parallel to said screen; and wherein said second section has a low friction inner surface so as to minimize the tendency of said first interior volume to clog.

13. Apparatus as recited in claim 12 wherein said second section is made of a material selected from the group consisting essentially of stainless steel and metal with a low friction interior surface coating.

14. Apparatus as recited in claim 2 further comprising valve means associated with each nipple for connecting said nipple to said source of fluid under pressure.

15. Apparatus as recited in claim 2 further comprising a common header for all of said nipples.

16. Apparatus as recited in claim 15 wherein said vessel has a plurality of supporting legs; and further comprising a plate connected to a supporting leg and extending inwardly therefrom, said plate supporting said header thereon.

17. Apparatus as recited in claim 16 wherein said header is annular, and wherein a plurality of said plates are provided connected to supporting legs, and supporting said header thereon, and further comprising U-bolts for connecting said header to said plates.

18. Apparatus as recited in claim 1 further comprising a second inner wall section of said vessel, above said first inner wall section, and generally parallel to said screen; and wherein said second section has a low friction inner surface so as to minimize the tendency of said first interior volume to clog.

19. A pressure diffuser for treating paper pulp, including a vessel having a first interior wall section adjacent a pulp inlet to the vessel and including a curved section, and a straight vertical section; and an interior up and down reciprocating screen supported by a bottom support exterior surface defining a passageway with the first interior wall section; and a first plurality of nipples disposed circumferentially around the first interior wall each having a valve associated therewith, and connected to the straight section of the vessel first interior wall for introducing liquid into the passageway;

a second plurality of nipples disposed circumferentially around the first interior wall each having a valve associated therewith, and connected to the curved section of the vessel first interior wall for introducing liquid into the passageway;

the second plurality of nipples being circumferentially staggered with respect to the first plurality; and an annular common header for supplying liquid to the first and second plurality of nipples.

* * * * *